United States Patent [19]

Bliss

[11] 4,115,975

[45] Sep. 26, 1978

[54] FOLDABLE/EXTENSIBLE STRUCTURE

[75] Inventor: Robert L. Bliss, Salt Lake City, Utah

[73] Assignee: University of Utah, Salt Lake City, Utah

[21] Appl. No.: 823,785

[22] Filed: Aug. 11, 1977

[51] Int. Cl.[2] ..... E04B 1/343

[52] U.S. Cl. ..... 52/646; 248/166; 248/432

[58] Field of Search ..... 52/109, 646; 135/20 R, 135/4 R, 2; 248/432, 166, 163, 150

[56] References Cited

U.S. PATENT DOCUMENTS

| | | | |
|---|---|---|---|
| 2,479,250 | 8/1940 | Mote | 135/20 R |
| 3,968,808 | 7/1976 | Zeigler | 52/109 |
| 4,026,313 | 5/1977 | Zeigler | 135/4 R |

FOREIGN PATENT DOCUMENTS

| | | | |
|---|---|---|---|
| 239,422 | 3/1959 | Australia | 135/2 |

*Primary Examiner*—James L. Ridgill, Jr.

[57] ABSTRACT

A foldable and extensible structure fabricated from one or more foldable and extensible base modules. Each base module is fabricated from six rigid members swivelly interconnected end-to-end in a closed figure with intersecting rigid members being pivotally connected. A plurality of base modules are selectively interconnected at adjacent swivels and, selectively, with additional rigid members or struts to thereby provide an enlarged, foldable and extensible truss-like structure. In one preferred embodiment, a plurality of base modules are interconnected in an end-to-end configuration to form an elongated, three-dimensional structure which folds into a triangular configuration having a relatively flat profile while, simultaneously, being extensible at a relatively high ratio to form the elongated structure. The base module can also be configurated as a collapsible and portable stool by being fitted with a triangular seat structure. The seat has a swivel-receiving pocket in each corner to individually receive one of the three swivels at one end of the base module. The swivels at the other end of the base module serve as feet for the stool.

12 Claims, 15 Drawing Figures

FOLDABLE/EXTENSIBLE STRUCTURE

BACKGROUND

1. Field of the Invention

This invention relates to foldable and extensible structures and, more particularly, to a foldable and extensible structure fabricated from one or more base modules, each base module being configurated from six rigid members flexibly interconnected end-to-end by swivels into a closed configuration generally approximating a double triangle in appearance when folded flat and having intersecting rigid members pivotally secured.

2. The Prior Art

Numerous applications can be found for foldable and extensible structures including, for example, pedestals, stools, trusses, antennae, extension arms, and the like. One familiar form of an extensible arm structure is a common "scissors" extension arm. The "scissors" extension arm involves a first pair of pivotally joined rigid members. Additional pairs of rigid members may be pivotally joined to the end of the first pair and each successive pair. Lateral movement of the free ends of the pair of rigid members imparts a corresponding movement to the pivotally interconnected pairs of rigid members resulting in a linear contraction and/or expansion of the extension arm. This is a well known apparatus and is found in numerous applications. However, this particular "scissors" extension arm is generally considered to be a two-dimensional configuration since all of the pivotal movement occurs in the same general plane and, therefore, lacks the necessary structural stability for various applications.

With respect to structural stability, it is well known that a generally triangular or three-dimensional basic structural configuration has desirable dimensional stability. It would, therefore, be an advancement in the art to provide a foldable and extensible structure fabricated with a generally triangular basal configuration and which is three-dimensionally foldable and extensible. An even further advancement in the art would be to provide an antenna-like structure which is foldable into a relatively flat configuration while being extensible into a structure having a significant ratio of extended length to folded length. Another advancement in the art would be to provide a novel basal module which is foldable and extensible and can be interconnected to form a plurality of foldable and extensible structures. Such a foldable and extensible structure is shown and claimed herein.

BRIEF SUMMARY AND OBJECTS OF THE INVENTION

The present invention relates to a foldable and extensible structure fabricated from one or a plurality of basal modular elements. Each basal modular element or base module is configurated from six rigid members flexibly joined end-to-end in swivels. Each base module is configurated as a closed structure of a generally double triangular configuration when viewed in its flat, folded configuration and includes intersecting rigid members being pivotally interconnected. The swivel arrangement allows the necessary flexure and twisting of each swivel joinder to accommodate the base module being folded and/or extended in either of two basic directions. A plurality of base modules may be selectively interconnected and with additional struts form a plurality of foldable and extensible structural configurations. Extension facilitating and limiting devices may also be included for providing an extensible structure which can be extended from a folded configuration.

It is, therefore, a primary object of this invention to provide improvements in foldable and extensible structures.

Another object of this invention is to provide a foldable basal modular element which can be used as a support structure for a stool and the like.

Another object of this invention is to provide a foldable and extensible structure wherein a plurality of basal modular elements are interconnected end-to-end for the purpose of providing a linearly extensible structure.

Another object of this invention is to provide a truss-like structure wherein a plurality of basal modular elements are selectively interconnected to provide a structure which is foldable for transportation, handling, and storage and, thereafter, extensible into the truss configuration.

These and other objects and features of the present invention will become more fully apparent from the following description and appended claims taken in conjunction with the accompanying drawing.

DETAILED DESCRIPTION OF THE PREFERRED EMBODIMENTS

Figure 1:
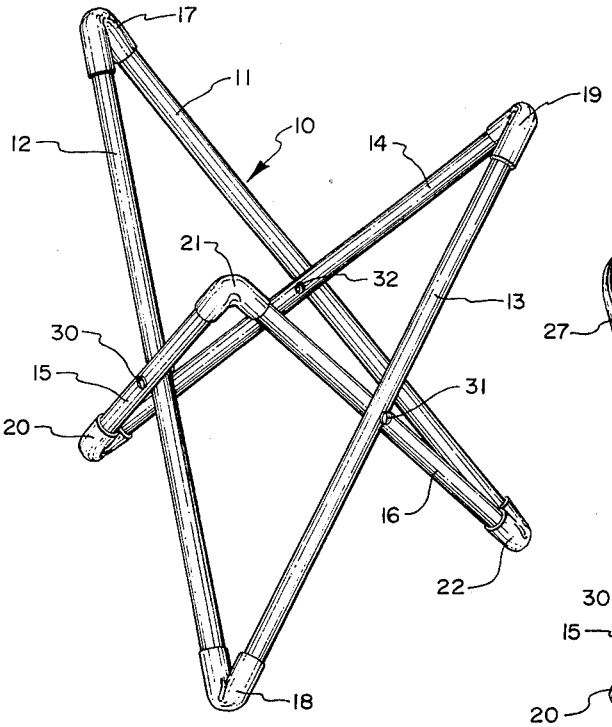
FIG. 1 is a perspective view of a first preferred embodiment of the basal modular element of this invention in one opened configuration.

The invention is best understood by reference to the drawing wherein like parts are designated with like numerals throughout.

Referring now more particularly to FIGS. 1–4, the basic modular component of this invention is shown as base module 10. Base module 10 is fabricated from a plurality of rigid members 11–16 serially interconnected by means of flexible swivels 17–22, respectively. Swivels 17–22 accommodate a hinge-type movement between the connected rigid members 11–16 in conjunction with a twisting or rotational movement when base module 10 is flexed between each of its two folded configurations that will be discussed more fully hereinafter. Rigid members 11–16 are of a generally uniform length and can be fabricated from any suitable rigid material such as dowels, tubular elements or the like which have sufficient structural strength characteristics to accommodate the structural load imposed on base module 10.

Rigid members 12 and 15 are pivotally connected by pivot 30 while rigid members 13 and 16 are pivotally connected by pivot 31 and rigid members 11 and 14 are pivotally connected by pivot 32. Pivots 31–32 are located adjacent the midpoint of the respective rigid members 11–16. Additionally, it should also be noted that the inside/outside relationship between the pivotally joined rigid members 11–16 alternates for each rigid member in the serial sequence. For example, rigid member 11 is pivotally secured to the outside of rigid member 14 whereas rigid member 12 is pivotally secured to the inside of rigid member 15 and rigid member 13 is pivotally secured to the outside of rigid member 16, etc. The terms "inside" and "outside" have been arbitrarily chosen herein to designate those portions of the base module generally facing the center of the structure and those portions generally facing outwardly, respectively.

Figure 3:
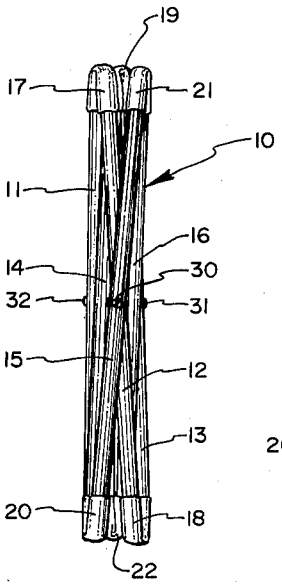
FIG. 3 is a side elevation of the basal modular element of FIGS. 1 and 2 folded into an elongated configuration.
Figure 4:
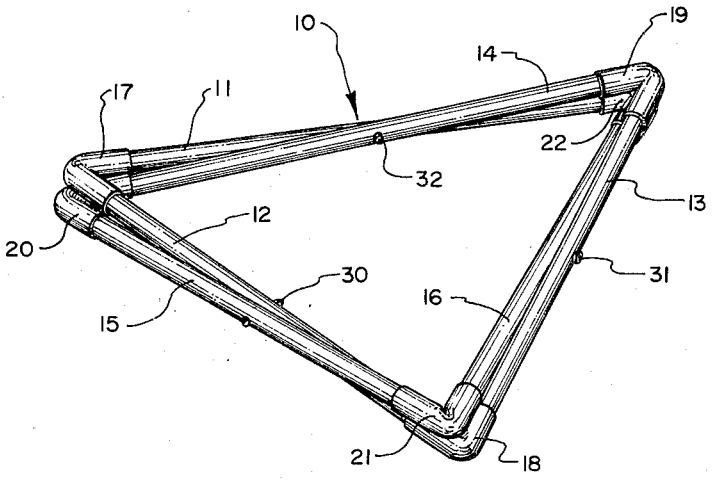
FIG. 4 is a perspective view of the basal modular element of FIGS. 1 and 2 folded in a generally flat, triangular configuration.

In the illustrated embodiment herein, swivels 17–22 are fabricated as flexible tubular segments to accommodate the foregoing hinge-type flexure and twisting of base module 10 through the range of positions between the longitudinally folded position illustrated in FIG. 3, and the flat, folded, triangular configuration illustrated in FIG. 4. The capability of base module 10 to be configurated in a variety of positions between that of FIGS. 3 and 4 provides a surprisingly wide variety of applications wherein a foldable/extensible structure is advantageously available. Representative examples of some of these structural configurations will be set forth more fully hereinafter. When folded into the flat configuration shown in FIG. 4, base module 10 forms a double coil configuration which assumes a generally triangular outline with each rigid member 11–16 approaching a parallel relationship to the plane of the flat configuration. On the other hand, when folded into the elongated configuration shown in FIG. 3, the rigid members 11–16 approach a generally parallel relationship to each other.

Figure 10:
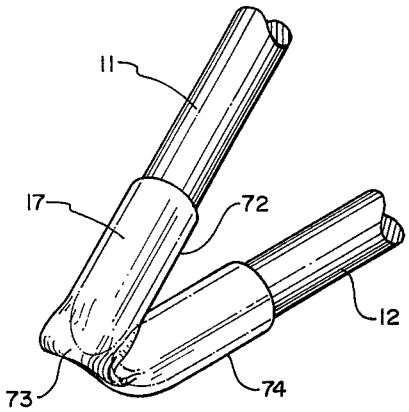
FIG. 10 is a perspective view of one preferred embodiment of the swivel arrangement of FIGS. 1–4 of this invention with portions broken away for ease of illustration.

Swivels 17–22 may be fabricated from a relatively short length of plastic or rubber tubing or the like, the primary criteria being flexibility and accommodating secure engagement between the respective rigid members. For example, referring more particularly to FIG. 10, swivel 17 is shown greatly enlarged and illustrates the manner in which rigid member 11 is interconnected to rigid member 12 by means of swivel 17. Swivel 17 is fabricated as a tubular element having a first end 72 coupled to rigid member 11 and a second end 74 coupled to rigid member 12. The midsection of the tubular element forms a flexible hinge member 73 to accommodate flexure and twisting between each of rigid elements 11 and 12. In this manner, the base module 10 can be readily folded into either the elongated configuration illustrated in FIG. 3, the flat configuration illustrated in FIG. 4, or the plurality of intermediate configurations shown generally as FIGS. 1 and 2.

Figure 2:
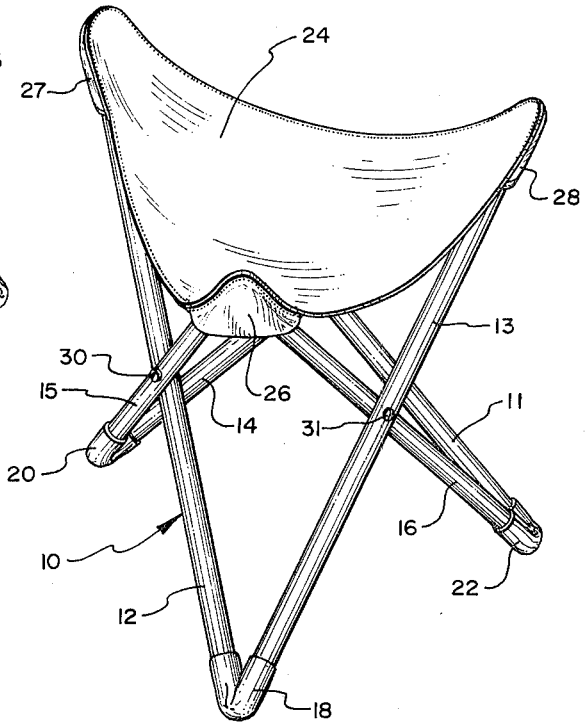
FIG. 2 is a perspective view of the basal modular element of FIG. 1 configurated as a stool having a seating element mounted thereon.

With particular reference to FIG. 2, base module 10 is fabricated as a portable stool or the like by means of a seat 24. Seat 24 is fabricated in an equilateral triangular configuration from a sufficiently stout material such as canvas, leather or the like. Additionally, seat 24 could be fabricated from a rigid material which may be either contoured as shown or be planar as when fabricated from plywood. Swivel-receiving pockets 26–28 are formed at each corner of seat 24 to accommodate receipt of swivels 21, 17, and 19 (FIG. 1), respectively. Base module 10 thereby serves as a stool wherein each of swivels 18, 20, and 22 serve as feet which rest upon the ground surface (not shown). In this manner, the three points represented by swivels 18, 20, and 22 rest firmly upon the ground and, as is well known, define a plane to thereby preclude the stool from rocking or otherwise being unstable.

Removal of seat 24 allows the structural support portion thereof, base module 10, to be folded into either of the configurations of FIGS. 3 or 4 for ease of handling, transportation, and storage. Reassembly is quickly accomplished by extending base module 10 into the configuration of FIGS. 1 and 2 while engaging swivels 17, 19, and 21 (FIG. 1) in the swivel-receiving pockets 27, 28, and 26, respectively.

Figure 5:
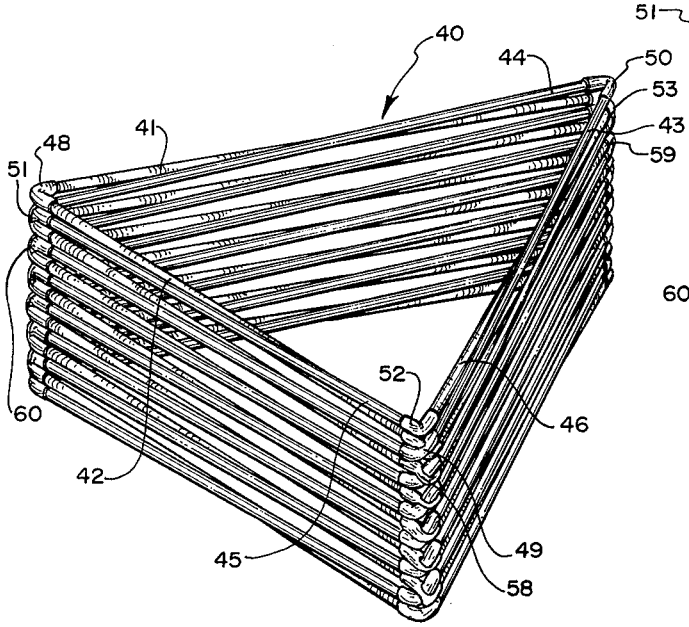
FIG. 5 is a perspective view of a plurality of basal modular elements interconnected end-to-end and folded in a generally flat, triangular configuration.
Figure 6:
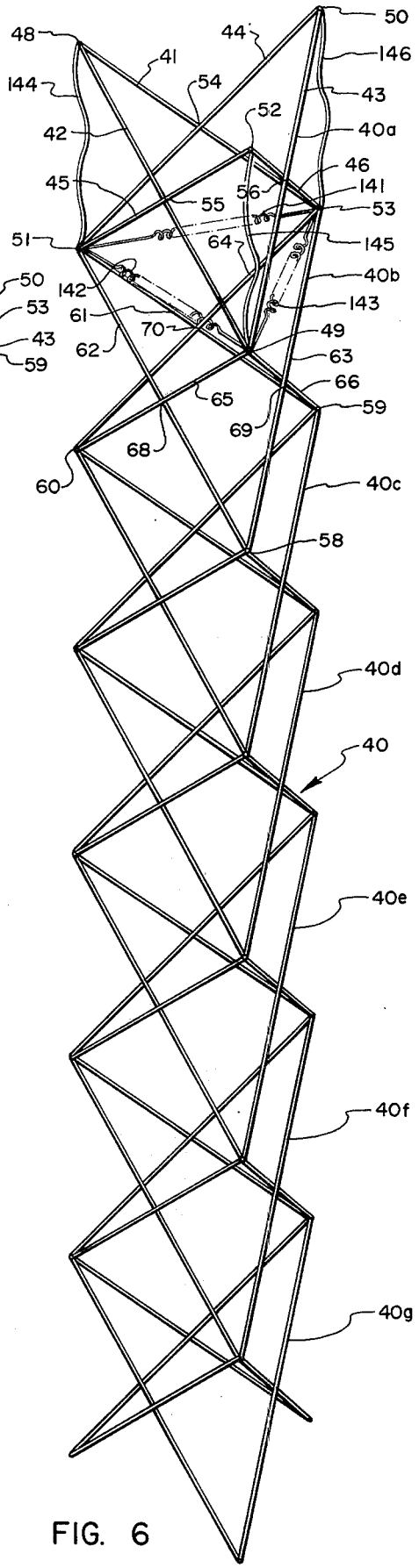
FIG. 6 is a perspective view of the apparatus of FIG. 5 in a partially extended configuration.

Referring now more particularly to FIGS. 5 and 6, a plurality of base modules shown herein as base modules **40*a*–40*g* are interconnected to form thereby an extensible structure 40. Each of base modules 40*a*–40*g* are configurated similar to base module 10. For example, a first base module 40*a* includes rigid members 41–46 serially interconnected by swivels 48–53, respectively. Additionally, the intersecting rigid members 41–46 are pivotally interconnected by pivots 54–56, respectively. A second base module 40*b* includes rigid members 61–66, swivels 58–60 and swivels 49, 51, and 53. Base module 40*a* is flexibly interconnected to base module 40*b* at corresponding swivels 49, 51, and 53. Accordingly, swivels 48, 51, and 53 serve as interties for flexibly interconnecting base module 40*a* to 40*b*. One possible configuration of this intertie is shown more clearly in FIG. 11 with respect to swivel/intertie 51**.

Figure 11:
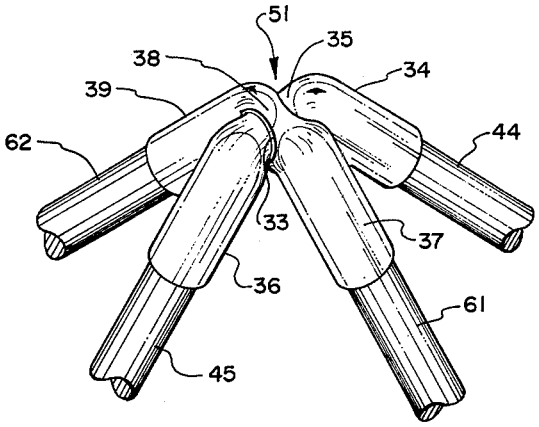
FIG. 11 is another preferred swivel embodiment of FIGS. 5 and 6 of the present invention for interconnecting two swivels of two adjoining base modules.

With particular reference to FIG. 11, swivel/intertie 51 is shown greatly enlarged to thereby more clearly illustrate the interconnection between rigid members 61 and 62 of base module **40*b* and rigid members 44 and 45 of base module 40*a*. Rigid members 44 and 45 are swivelly interconnected by a flexible member 35 while rigid members 61 and 62 are swivelly interconnected by a flexible member 38. Flexible member 35 includes tubular ends 34 and 36 which telescopically engage the ends of rigid members 44 and 45, respectively. The flexible segment of flexible member 35 between tubular ends 34 and 36 provides the necessary flexible, swivel interconnection between rigid members 44 and 45. Flexible member 38 also includes a flexible tubular element having tubular ends 37 and 39 secured to rigid members 61 and 62**, respectctively. The flexible portion of flexible member 35 between tubular ends 34 and 36 passes through an aperture 33 in the flexible segment of flexible member 38 thereby providing a flexible interconnection between flexible members 35 and 38 for the purpose of providing swivel intertie 51.

Referring again to FIGS. 5 and 6 and the illustrated embodiment for extensible structure 40, the plurality of flexibly interconnected base modules 40*a*–40*g* provide the extensible structure which may be folded into the substantially flat configuration illustrated in FIG. 5 or extended into the elongated position illustrated in FIG. 6. Extensibility is provided by the flexible interconnects or swivel/interties between each of base modules 40*a*–40*g*. For example, bringing each of the corresponding flexible interconnects together toward the center of the extensible structure 40 causes a corresponding linear or generally parallel orientation of the respective rigid members in each of base modules 40*a*–40*g*. This change in configuration is similar to that represented by reorientation of base module 10 (FIGS. 1–4) from its flat configuration (FIG. 4) through its intermediate configurations (FIG. 1 and 2) toward the linear configuration (FIG. 3).

To assist in extending extensible structure 40 from its folded configuration (FIG. 5), a plurality of tension members 141–143 may be incorporated. Tension members 141–143 are schematically illustrated and may be included at other preselected locations on extensible structure 40. Tension members 141–143 exert a pulling force between the respective swivel/interties 48, 51, and 53. This pulling force causes the respective rigid members of the respective base modules to attain a more generally parallel orientation with a corresponding extension of extensible structure 40 as shown in FIG. 6. For example, tension member 141 is interconnected between swivel/intertie 51 and 53 while tension member 142 is interconnected between swivel/interties 51 and 49 and tension member 143 is interconnected between swivel/interties 59 and 53. Only one set of tension members 141–143 is shown herein for ease of illustration. Clearly, however, other suitable tension members could be suitably connected between the appropriate swivel/interties between base modules 40*a*–40*g*. Additionally, other suitable tension members (not shown) could also be provided between the various pivotal points such as pivots 54–56 and pivots 68–70 of base module 40*a* and base module 40*b*, respectively.

To prevent the excessive elongation of extensible structure 40, a plurality of restraints 144–146 may be provided for the purpose of limiting the linear distance to which base module 40*a* may be extended. In this event, each of restraints 144–146 are fabricated from a suitable flexible cord material and connected between corresponding swivels of base module 40*a*. The length of each of restraints 144–146 is preselected so as to limit the extension of base module 40*a*. Additional restraints (not shown) may also be interconnected between the various swivels and swivel/interties of each of the succeeding base modules 40*b*–40*g*. The foregoing tension members and restraint configuration (as illustrated schematically by tension members 141–143 and restraints 144–146, respectively) readily adapts the extensible structure 40 into a structural configuration which may be folded into a relatively compact configuration as illustrated in FIG. 5 and subsequently extended into a substantially elongated configuration as illustrated in FIG. 6. This would be particularly advantageous for certain space applications, for example, wherein it would be advantageous to have an antenna structure folded within a space vehicle and subsequently extended to a preselected length. Additionally, the outline provided by restraints 144 and 145 in addition to tension member 142 and a corresponding tension member (not shown) interconnected between swivels 48 and 52 could serve as a framework for a flexible fabric element (not shown) for the purpose of providing a surface covering over at least one face of base module 40*a*. Repetitive covering elements over each of the respective faces of base modules 40*a* and 40*g* would configure the extensible structure 40 as a structure having a substantially solid-appearing exterior configuration. If the foregoing fabric material were fabricated from a conductive material such as aluminized mylar or the like, then the previously described antenna configuration would be substantially enhanced for certain applications.

Figure 12:
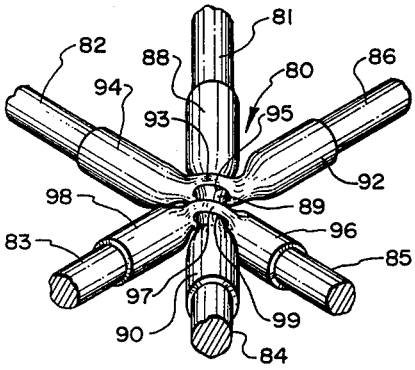
FIG. 12 is a perspective view of one preferred embodiment for fabricating an intertie between a strut and a swivel.

Referring now more particularly to FIG. 12, another flexible swivel interconnect is shown as interconnect 80 and includes at least three swivels, swivels 89, 93, and 97, flexibly interconnected in a manner substantially similar to swivel/intertie 51 shown in FIG. 11. For example, swivel 89 having tubular segments 88 and 90 serves to swivelly join rigid members 81 and 84, respectively. Correspondingly, swivel 93 having tubular segments 92 and 94 swivelly joins rigid members 86 and 82, respectively. Swivel 97 swivelly joins rigid members 83 and 85 by engaging therewith tubular segments 98 and 96, respectively. The flexible portion of swivels 93 and 97 are provided with apertures 95 and 99, respectively, through which the flexible portion of swivel 89 is passed. In the particular configuration illustrated in FIG. 12, at least two of the rigid members may be configurated as struts and the remaining rigid elements may be configurated as rigid elements in interjoined base modules as will be discussed more fully hereinafter with respect to FIGS. 7–9.

Figure 14:
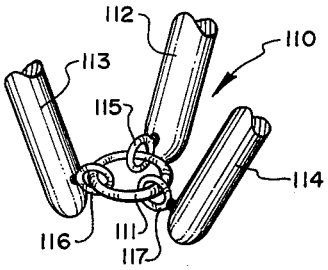
FIG. 14 is a perspective view of another embodiment of an intertie.

With particular reference to FIG. 14, another possible swivel, swivel/intertie, or interconnect configuration is shown whereby a plurality of eye bolts 115–117 are shown engaged to a ring 111 to form the appropriate joinder configuration 110. Eye bolts 115–117 are mounted to the ends of rigid members 112–114, respectively, and through their engagement with ring 111 provide the necessary flexible joint for the swivel arrangement illustrated. Although only three rigid members, rigid members 112–114 are shown, clearly, any suitable number of rigid members could be flexibly joined to ring 111 to form the preselected foldable/extensible structure.

Figure 15:
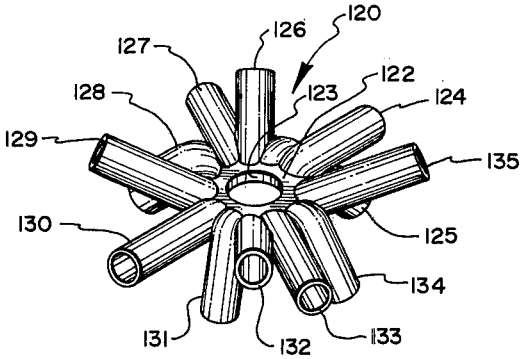
FIG. 15 is a perspective view of another intertie.

Referring now more particularly to FIG. 15, another intertie embodiment is illustrated as intertie 120. Intertie 120 includes a basal element 122 having a plurality of tubular elements 124–135 joined thereto. Accordingly, a plurality of rigid members (not shown) may be flexibly joined into intertie 120 for the purpose of providing a suitable joinder between the various struts and rigid members of the particular structure, as may be selectively predetermined.

Intertie 120, including basal elements 122 and tubular elements 124 and 135 is, selectively, fabricated from a suitable flexible material such as rubber, plastic, or the like. Each of the tubular elements is fabricated with a hollow bore for the purpose of receiving corresponding ends of rigid members (not shown) therein. Additional flexibility is imparted to intertie 120 by means of an aperture 123 in basal element 122.

Figure 13:
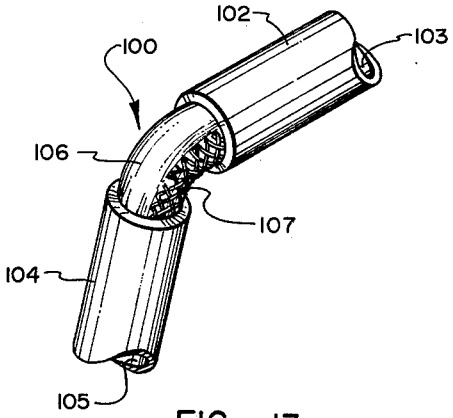
FIG. 13 is a perspective view of another embodiment for a swivel.

Referring now more particularly to FIG. 13, another possible swivel configuration, swivel 100, is shown for interconnecting tubular, rigid members 102 and 104. In particular, each of rigid members 102 and 104 is configurated with a hollow bore 103 and 105, respectively. A discrete length of flexible member 106 is inserted at each end into bores 103 and 105 of rigid members 102 and 104, respectively. The flexible member 106 provides the necessary flexure and twisting to accommodate forming a swivel 100. Flexible member 106 can be fabricated as a solid rubber element or the like and may include suitable reinforcement such as reinforcement threads 107 thereon for the purpose of strengthening flexible member 106. Additionally, flexible member 106 may be fabricated as a hollow tubular element having a bore (not shown) passing therethrough. Regardless of the particular material and method of construction, flexible member 107 provides the necessary hinge-type and twistable swivel interconnection between rigid members 102 and 104. Accordingly, swivel 100 serves the same function, for example, as swivel 73 (FIG. 10), and the various swivels of FIGS. 1–6.

Figure 7:
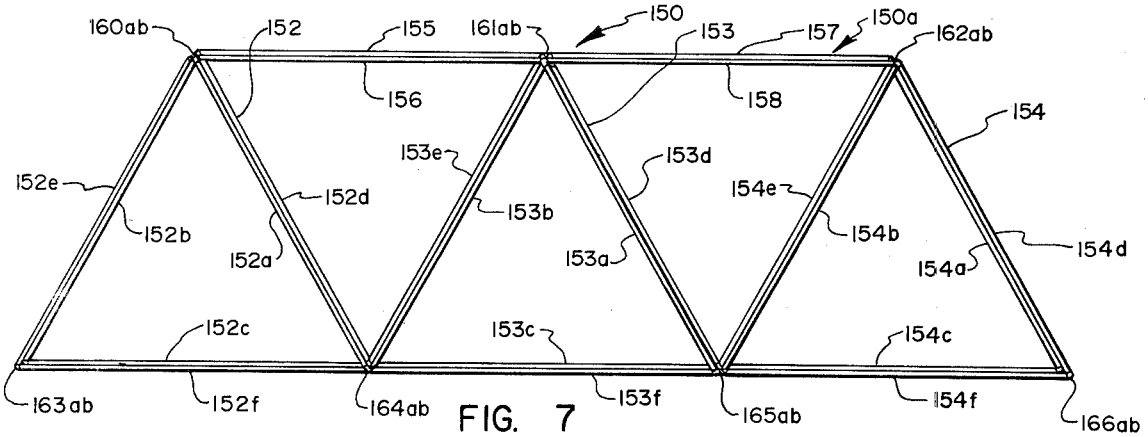
FIG. 7 is a side elevation of a truss-like structure fabricated from a plurality of basal modular elements and folded into a generally flat configuration.
Figure 8:
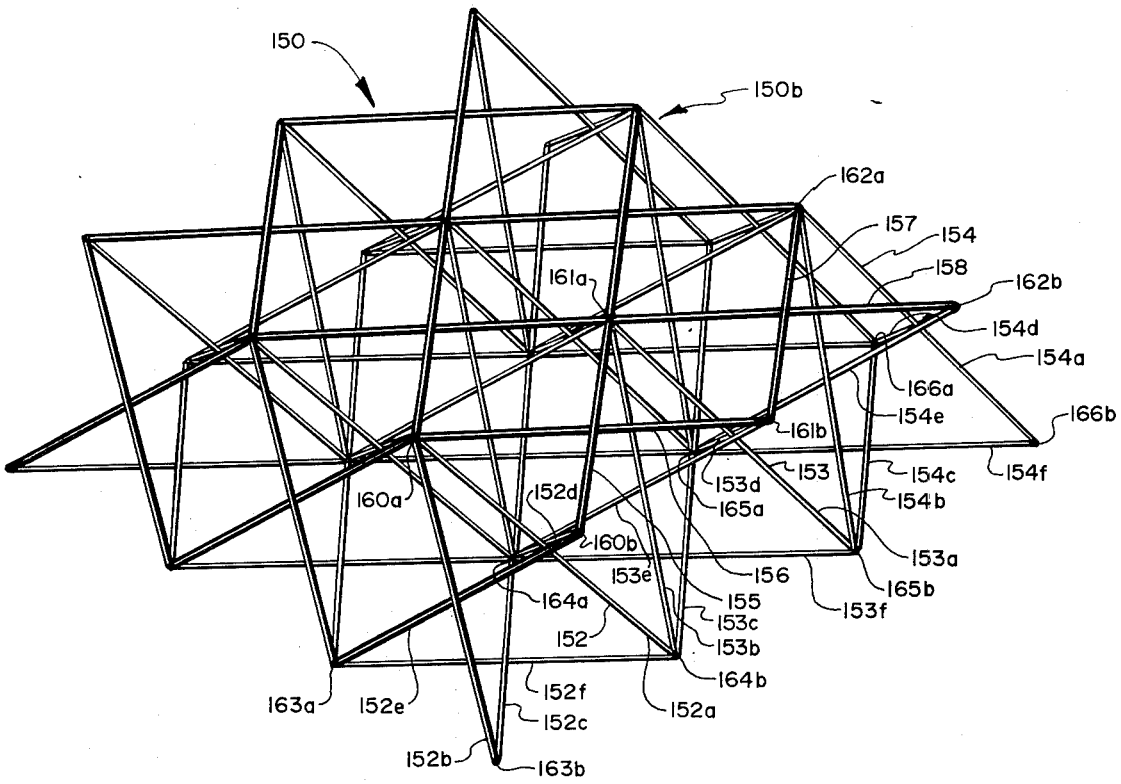
FIG. 8 is a perspective view of the truss-like structure of FIG. 7 in an extended configuration.
Figure 9:
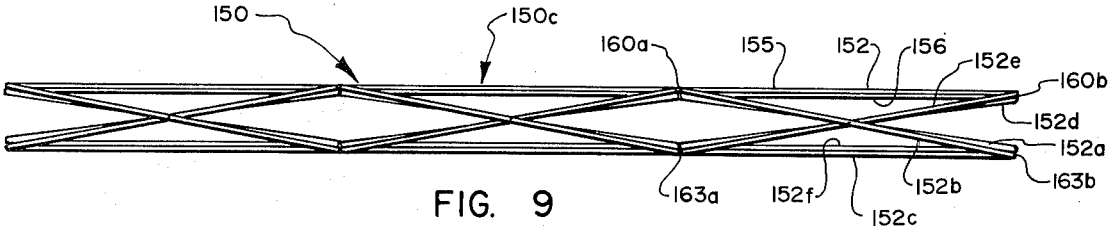
FIG. 9 is a plan view of the truss-like structure of FIGS. 7 and 8 folded into a generally linear configuration.

Referring now more particularly to FIGS. 7–9, another preferred embodiment of the invention is illustrated herein wherein a plurality of base modules, represented by base modules 152–154, are shown interconnected to form a truss-like structure 150. Truss-like structure 150 is foldable/extensible into a plurality of configurations including a flat configuration **150*a* (FIG. 7), an extended configuration 150*b* (FIG. 8), and an elongated, linear configuration 150*c* (FIG. 9**).

Base module 152 includes rigid members **152*a*–152*f* while base module 153 includes rigid members 153*a*–153*f* and base module 154 includes rigid members 154*a*–154*f*. Base module 152 is flexibly connected to base module 153 at swivels 164*a* and 164*b* while base module 153 is connected base 154 at swivels 165*a* and 165*b*. Swivels 160*a* and 160*b* of base module 152 are interconnected to swivels 161*b* and 161*a* of base module 153 by struts 156 and 155, respectively. Correspondingly, swivels 161*a* and 161*b* of base module 153 are interconnected to swivels 162*b* and 162*a* of base module 154 by struts 158 and 157, respectively. The inter-relationship of the foregoing base modules, struts, and swivels is best illustrated in FIG. 8 but may also be seen in FIG. 7**.

With particular reference to FIG. 7, base modules 152–154 are folded in the flat configuration similar to that of a single base module (FIG. 4) and a plurality of base modules, extensible structure 40 (FIG. 5). The direction of folding for the truss-like structure 150 shown in FIG. 7 is perpendicular to the plane of the paper. Each of base modules 152–154 also lie in essentially the same plane, which is parallel to the plane of the paper.

At this point it should be particularly emphasized that, for sake of clarity and brevity, only base modules 152–154 have been given numbers to thereby minimize the potential for confusion This is believed necessary since each base module includes six rigid members and are each interconnected by at least two struts between each base module. For example, with particular reference to FIG. 8, base modules 152–154 are shown in the expanded configuration and are interconnected to each other by the appropriate struts, struts 155–158. In addition to having a width of three base modules, the truss-like structure **150*b* (FIG. 8) includes a depth of at least three base modules behind each of the designated base modules 152–154. Accordingly, there are nine base modules with six rigid members each for a total of 45 rigid members. There is also a total of six double strut systems comparable to struts 155–158 for a total of twelve struts. The truss-like structure 150, therefore, includes a total of 57 rigid members and struts flexibly joined end-to-end in swivels and interties, where appropriate, and pivotally joined at their midpoints where they intersect. To label and discuss each of these rigid members, struts, swivels, and interties would render the present description unduly prolix without significantly advancing or otherwise clarifying the description of the truss-like structure 150. Accordingly, the present discussion revolves around the inter-relationship of base modules 152–154 with the understanding that the plurality of additional base modules are similarly interconnected (as shown) to base modules 152–154 thereby providing the truss-like structure 150**.

With particular reference to FIG. 9, the truss-like structure 150 is folded into a generally linear configuration **150*c*. This is similar to the configuration of base module 10 shown in FIG. 3 and is obtained by orienting the various rigid members into a near-parallel orientation. For example, this near parallel orientation of the various rigid members and struts of truss-like structure 150 is attained by extending the flat configuration 150*a* shown in FIG. 7 (when viewed from the left side) vertically from the plane of the paper. This is the same view that would be obtained by viewing the truss-like structure 150 in its extended configuration 150*b* of FIG. 8 from the lower left side and continuing the extension of the truss-like structure 150 by bringing swivel 160*a* toward swivel 163*a* and, correspondingly, swivel 160*b* toward 163*b*. Accordingly, when viewed as the linear configuration 150*c* in FIG. 9, base module 152 is seen whereas base modules 153 and 154 are hidden therebehind. Base module 152 thereby is folded into the linear configuration generally similar to the folded configuration of base module 10 shown in FIG. 3. The underlying base modules, base modules 153 and 154 are not illustrated for sake of clarity in FIG. 9 since they are obscured or hidden behind base module 152. Each of swivels 160*ab*–166*ab* are so designated because they represent superimposed swivels 160*a*/160*b*–166*a*/166*b*. Sumperimposition is done herein for the purpose of showing that each of the respective swivels are seen in alignment when the truss-like structure 150 is folded into the generally flat configuration 150*a* (FIG. 7**).

The truss-like structure 150 is readily adaptable for a plurality of uses including, for example, an extendable truss which may be folded in either the flat configuration **150*a* (FIG. 7) or the linear configuration 150*c* (FIG. 9) for ease of transportation and handling. Thereafter, the truss-like structure 150 may be extended into the extended configuration 150*b* (FIG. 8) where it may serve as a roof truss, support for a swimming pool cover, recreation area cover or the like. The truss-like structure 150 may also be adapted as an antenna structure similar to extensible structure 40 (FIGS. 5 and 6). Additionally, truss-like structure 150 may include a plurality of tension members similar to tension members 141–143 (FIG. 6) and extension limiters or restraints 144–146 (FIG. 6) which would serve in assisting the extension and securement of truss-like member 150 upon release from either the flat configuration 150*a* (FIG. 7) or the elongated configuration 150*c* (FIG. 9**). In either configuration, the foregoing tension members assist in achieving the extension of the truss-like structure into the desired configuration whereupon the foregoing restraints provide the necessary counteracting force to the force of the tension members.

The invention may be embodied in other specific forms without departing from its spirits or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A foldable and linearly extensible structure comprising:

a plurality of base modules, each base module comprising six rigid members flexibly interconnected end-to-end in a closed figure with the closed figure being configurated with:

one end of the first rigid member swivelly interconnected to one end of a second rigid member in a first swivel;

the other end of the second rigid member swivelly interconnected to one end of a third rigid member in a second swivel;

the other end of the third rigid member swivelly interconnected to one end of a fourth rigid member in a third swivel;

the other end of the fourth rigid member swivelly interconnected to one end of a fifth rigid member in a fourth swivel;

the other end of the fifth rigid member swivelly interconnected to one end of sixth rigid member in a fifth swivel;

the other end of the sixth rigid member swivelly interconnected to the other end of the first rigid member in a sixth swivel;

each base module further including the first rigid member pivotally connected to the inside of the fourth rigid member in a first pivot, the second rigid member pivotally connected to the outside of the fifth rigid member in a second pivot and the third rigid member pivotally connected to the inside of the sixth rigid member in a third pivot, all of said pivotal connections being made adjacent the midpoint of each respective rigid member; and said foldable and linearly extensible structure comprising flexibly and serially interconnected base modules, wherein a first base module is flexibly interconnected to a second base module by flexibly joining the first, third and fifth swivels of the first base module to the second, fourth and sixth swivels of the second base module, respectively, and the second base module is flexibly interconnected to a third base module by flexibly joining the first, third and fifth swivels of the second base module to the second, fourth and sixth swivels of the third base module, respectively, thereby swivelly and flexibly interconnecting a plurality of base modules to form the foldable and linearly extensible structure, the structure being foldable into a relatively flat configuration having a triangular outline.

2. The foldable and extensible structure defined in claim 1 wherein the swivels are fabricated as interconnected eye bolts to accommodate the swivel flexure between the interconnected rigid members.

3. The foldable and extensible structure defined in claim 1 wherein at least one tension member is selectively interconnected between spaced locations on two rigid members, the tension member providing a resilient tensile force to pull one rigid member toward the other thereby tending to alter the dimensional characteristics of the base modules.

4. The foldable and extensible structure defined in claim 3 wherein the structure further comprises at least one restraint to limit the alteration of the dimensional characteristics of the base modules.

5. The foldable and extensible structure defined in claim 1 wherein the swivel interconnection between each of the rigid members comprises a length of flexible material with each end of the flexible material attached to an end of the rigid member, the flexible material providing a twisting and bending flexure to accommodate folding and extending the base module.

6. The foldable and extensible structure defined in claim 5 wherein the flexible material is a length of elastomeric tubing.

7. The foldable and extensible structure defined in claim 5 wherein the rigid members include an axial bore at each end and the flexible material is attached inside the axial bore.

8. The foldable and extensible structure defined in claim 7 wherein the flexible material is configurated as a flexible rod having a diameter corresponding to the internal diameter of the axial bore of the rigid members.

9. A foldable and extensible truss structure comprising:

a plurality of base modules, each base module comprising six rigid members flexibly interconnected end-to-end in a closed figure with the closed figure being configurated with:

one end of the first rigid member swivelly interconnected to one end of a second rigid member in a first swivel;

the other end of the second rigid member swivelly interconnected to one end of a third rigid member in a second swivel;

the other end of the third rigid member swivelly interconnected to one end of a fourth rigid member in a third swivel;

the other end of the fourth rigid member swivelly interconnected to one end of a fifth rigid member in a fourth swivel;

the other end of the fifth rigid member swivelly interconnected to one end of sixth rigid member in a fifth swivel;

the other end of the sixth rigid member swivelly interconnected to the other end of the first rigid member in a sixth swivel;

the base module including the first rigid member pivotally connected to the inside of the fourth rigid member in a first pivot, the second rigid member pivotally connected to the outside of the fifth rigid member in a second pivot and the third rigid member pivotally connected to the inside of the sixth rigid member in a third pivot, all of said pivotal connections being made adjacent the midpoint of each respective rigid member;

the truss structure including a first base module interconnected to at least a second base module to thereby form an extensible structure wherein a first swivel of the first base module is flexibly interconnected to a fourth swivel of the second base module in a first intertie, a third swivel of the first base module is flexibly interconnected to a sixth swivel of the second base module in a second intertie, and a fifth swivel of the first base module is flexibly interconnected to a second swivel of the second base module in a third intertie;

the first and second base modules being interconnected to at least a third base module with a second swivel of the third base module flexibly interconnected to a fourth swivel of the first base module in a fourth intertie and a fifth swivel of the third base module flexibly interconnected to the first intertie between the first swivel of the first base module and the fourth swivel of the second base module;

a first rigid strut member flexibly interconnected between a sixth swivel of the first base module and a third swivel of the third base module; and a second rigid strut member flexibly interconnected between the second intertie and a sixth swivel of the third base module, the first and second rigid strut members being pivotally interconnected adjacent their midpoints.

10. A foldable stool comprising:

a base comprising six rigid members having a uniform length and serially joined end-to-end by a swivel into a double coil configuration having a generally triangular outline when placed so that the six rigid members are generally parallel to the same plane, the swivels accommodating simultaneous hinge-type and twisting movement of each rigid member relative to the next rigid member;

adjacent pairs of rigid members being pivotally joined adjacent their midpoint; and a separate seat adapted to be removably placed on the base and comprising a generally triangular structure having a swivel-receiving pocket at each corner of the triangular structure, each swivel being received in a swivel-receiving pocket to adapt the base to support the seat, the seat being removable from the base.

11. The foldable and extensible truss structure defined in claim 9 wherein the interties are each fabricated from a flexible material and include a planar, basal element having a plurality of tubular elements joined thereto, each of the tubular elements being adapted to receive an end of a rigid member therein.

12. A foldable stool structure comprising:

a base module comprising six rigid members flexibly interconnected end-to-end in a closed figure with the closed figure being configurated with:

one end of the first rigid member swivelly interconnected to one end of a second rigid member in a first swivel;

the other end of the second rigid member swivelly interconnected to one end of a third rigid member in a second swivel;

the other end of the third rigid member swivelly interconnected to one end of a fourth rigid member in a third swivel;

the other end of the fourth rigid member swivelly interconnected to one end of a fifth rigid member in a fourth swivel;

the other end of the fifth rigid member swivelly interconnected to one end of sixth rigid member in a fifth swivel;

the other end of the sixth rigid member swivelly interconnected to the other end of the first rigid member in a sixth swivel;

the base module including the first rigid member pivotally connected to the inside of the fourth rigid member in a first pivot, the second rigid member pivotally connected to the outside of the fifth rigid member in a second pivot and the third rigid member pivotally connected to the inside of the sixth rigid member in a third pivot, all of said pivotal connections being made adjacent the midpoint of each respective rigid member; and a seating element adapted to be removably placed on the base module, the seating element comprising a triangular seat having an equilateral triangular configuration and a swivel-receiving pocket at each corner of the triangular configuration for removably receiving one of the first, third and fifth swivels in each of the swivel-receiving pockets.

* * * * *